United States Patent [19]

Crooks et al.

[11] 3,932,911

[45] Jan. 20, 1976

[54] STRUCTURE FOR MOUNTING AIR MOVING MEANS IN A VACUUM CLEANER

[75] Inventors: Stanley R. Crooks, Shakopee; Warren H. Fish, White Bear Lake, both of Minn.

[73] Assignee: Whirlpool Corporation, Benton Harbor, Mich.

[22] Filed: Jan. 16, 1974

[21] Appl. No.: 433,917

[52] U.S. Cl. ..... 15/327 D; 15/412

[51] Int. Cl.[2] ..... A47L 9/22

[58] Field of Search ..... 15/327 R, 327 D, 327 E, 15/412; 248/2, 14

[56] References Cited

UNITED STATES PATENTS 2,542,634 2/1951 Davis et al. ..... 15/412 X 3,320,727 5/1967 Farley et al. ..... 15/327 R X

*Primary Examiner*—Harvey C. Hornsby
*Assistant Examiner*—C. K. Moore
*Attorney, Agent, or Firm*—Hofgren, Wegner, Allen, Stellman & McCord

[57] ABSTRACT

A structure for mounting an air moving apparatus in a vacuum cleaner including support shoulders formed integral with a housing portion of the vacuum cleaner and a spring bracket removably supporting the air moving apparatus on the shoulders within an air flow passage. The bracket embraces the air moving apparatus and defines opposite end portions resting on the support shoulders.

17 Claims, 4 Drawing Figures

10
15
12
14

16
21
11
17
13
3.
3.
44
14
38
11
23
25
24
31
34
33
32

30
3.
34
28
33
35
24
36
19
34
31
36
35
33
32
27
29
3.

21
11
20
39
38
17
25
22
18
23
37
37
31
26
4.
4.
28
40
27
24
41
19
43
43
42

STRUCTURE FOR MOUNTING AIR MOVING MEANS IN A VACUUM CLEANER

BACKGROUND OF THE INVENTION

1. Field of the Invention

This invention relates to vacuum cleaners, and in particular to means for mounting air moving means in vacuum cleaners.

2. Description of the Prior Art

In one form of conventional vacuum cleaner, a housing is provided having a base portion carrying an air moving means which may comprise a motor-blower structure. A number of different devices have been developed for supporting the motor-blower structure in the vacuum cleaner.

Illustratively, as shown in U.S. Pat. No. 2,875,466 of C. E. Nyberg, a flexible support diaphragm is provided formed of rubbery material and including an outer edge portion secured to the vacuum cleaner by a metal band. In U.S. Pat. No. 3,101,889 of R. B. Tatge, the resilient mounting for the motor and fan unit includes a resilient annular wall member carried by an inturned annular flange of the vacuum cleaner housing, and screws securing the motor-fan unit to the inner edge of the resilient wall member.

In U.S. Pat. No. 3,634,905 of Wilton E. Boyd, a vacuum cleaner construction is disclosed wherein the motor-fan unit is clamped between two halves of the housing with the opposite ends of the motor-fan unit engaging resilient annular supports carried by the housing.

Mitsuo Ohira et al. disclose, in U.S. Pat. No. 3,731,465, an electric vacuum cleaner which is similar to the Boyd structure in providing a motor-fan unit which is clamped between two halves of the vacuum cleaner housing and utilizes resilient seals at opposite ends of the fan unit for resiliently supporting the unit to the housing.

SUMMARY OF THE INVENTION

The present invention comprehends an improved means for mounting the air suction means of a vacuum cleaner to the housing portion thereof including a bracket means embracing a portion of the air suction means and removably retaining the air suction means on a plurality of retaining shoulders formed integrally with the vacuum cleaner housing. The mounting structure of the present invention is extremely simple and economical of construction and effectively eliminates the need for mechanical fasteners and the like, thereby simplifying installation and minimizing cost.

More specifically, the invention comprehends an improved structure for mounting a suction means including an air moving means and an electric drive motor in a vacuum cleaner, including means defining a housing portion of the vacuum cleaner, means integral with the housing portion defining an air flow passage having an inlet and an outlet, and means defining a plurality of retaining shoulders integral with the air flow passage means. The mounting structure further includes bracket means resting on the retaining shoulders and retaining the suction means in the air flow passage adjacent the inlet for drawing air through the inlet and discharging it through the outlet.

The bracket means illustratively comprises herein a U-shaped element which may be formed of resilient material, such as metal. The U-shaped bracket embraces opposite sides of the air suction means, and in the illustrated embodiment, embraces the motor means thereof subjacent the blower portion. Further in the illustrated embodiment, the bight portion of the U-shaped bracket rests on one of the opposite portions of the shoulder means and the distal ends of the leg portions rest on the other of the opposite portions of the shoulder means. The distal ends of the legs are biased apart by the resiliency of the bracket to provide retained association of the bracket with the shoulder means in the installed arrangement of the mounting structure.

In the illustrated embodiment, the drive motor includes a rectangular horizontal cross section portion and the bracket means include straight portions embracing opposite sides of the rectangular cross section portion.

A resilient seal may be provided at the upper end of the blower portion of the air suction means which compressively biases the air suction means against the bracket means. The bracket means is preferably vertically rigid and horizontally flexible to provide facilitated installation and removal of the air suction means while yet assuring positive retained association thereof with the vacuum cleaner housing in the assembled arrangement of the apparatus.

The bracket means effectively defines a snap-in mounting structure. The portion of the housing defining the air flow passage in which the air suction means is retained may be formed of insulative material to provide an improved insulated enclosure of the air suction means while yet providing effectively positive mounted association of the air suction means therein by means of the improved mounting structure.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4:
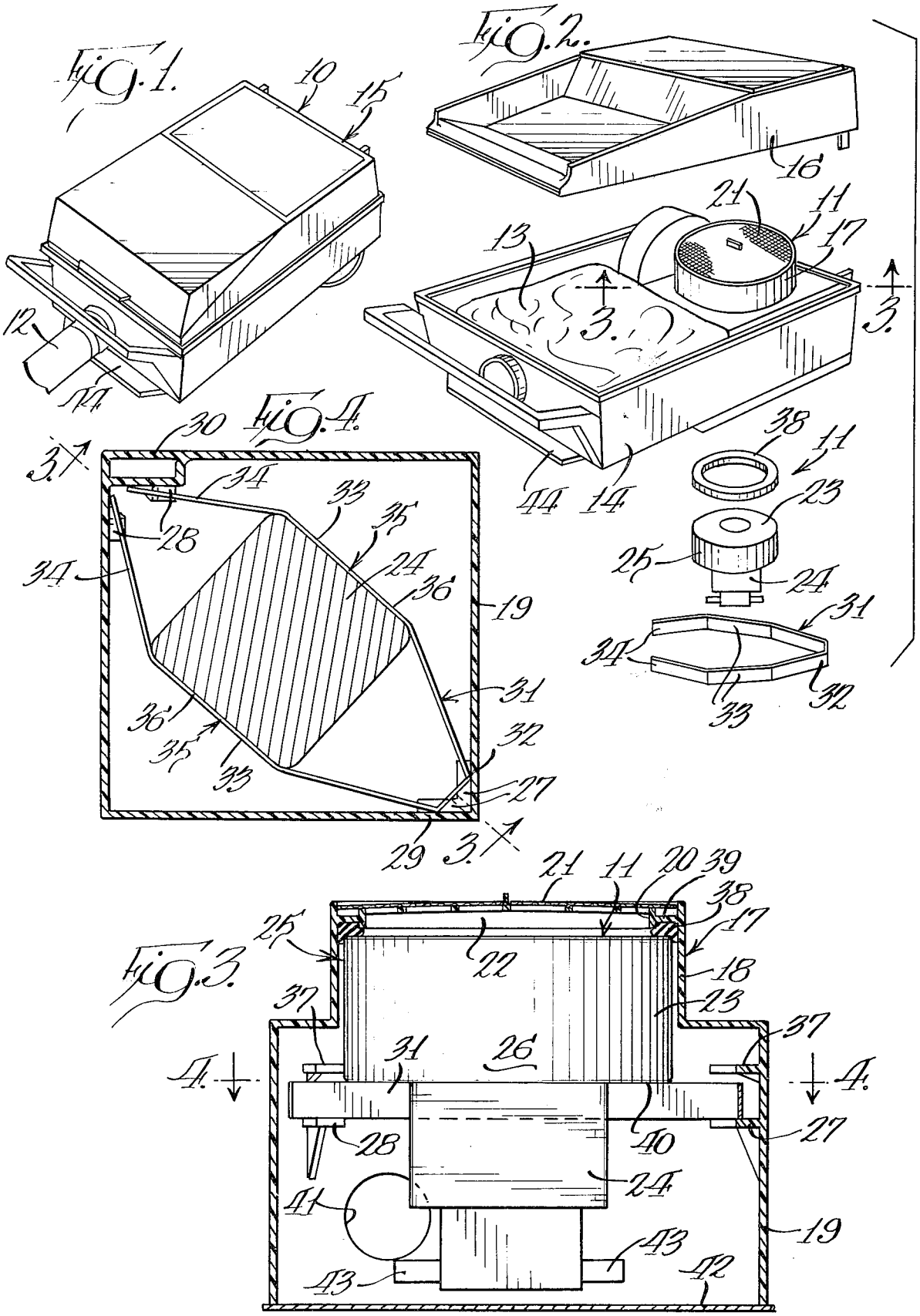
FIG. 1 is a perspective view of a vacuum cleaner having an improved structure for mounting the suction means thereof embodying the invention.
FIG. 2 is an exploded view thereof illustrating the arrangement of the air suction means relative to the vacuum cleaner housing.
FIG. 3 is a vertical section taken substantially along the line 3—3 of FIGS. 2 and 4.
FIG. 4 is a horizontal section taken substantially along the line 4—4 of FIG. 3.

In the exemplary embodiment of the invention as disclosed in the drawing, a vacuum cleaner generally designated 10 is provided with an air suction means generally designated 11 for drawing air through a suction tube 12 into a dirt collecting bag 13. Bag 13 may be provided in the base portion 14 of a canister housing 15 which is normally closed by a cover 16.

The air suction means is carried at the rear portion of the canister base 14 in a tubular enclosure portion 17 of the housing including a cylindrical upper portion 18 and a square cross section lower portion 19. Upper portion 18 defines an inlet opening 20 across which is removably mounted a filter pad 21 on a pervious support 22 which may be formed integrally with the housing portion 18, as shown in FIG. 3.

The air suction means including an air moving means 23 illustratively comprising a blower, and an electric drive motor 24 which are mounted as a unit to define a motor-blower unit 25. Housing portion 18 and 19 define an air flow passage 26 in which the motor-blower unit 25 is disposed in the assembled relationship of the apparatus, as shown in FIG. 3. The blower portion 23 extends into the upper cylindrical portion 18 of the housing adjacent inlet 20 and the motor 24 is disposed within the lower rectangularr section portion 19 of the housing. rectangular Motor-blower unit 25 is retained in the enclosure portion 17 adjacent inlet 20 by means of a plurality of retaining shoulders 27 and 28. As best seen in FIG. 4, shoulders 27 comprise a pair of perpendicularly extending shoulders at one corner 29 of the housing portion 19 and shoulders 28 comprise a pair of perpendicularly extending shoulders at the opposite corner 30 of enclosure portion 19.

Motor-blower unit 25 is retained by a removable bracket 31 which embraces the motor portion 24 subjacent the blower portion 23 of unit 25. Bracket 31 rests on shoulders 27 and 28 and blower portion 23 rests on bracket 31 to provide a readily removable mounting of unit 25 in the tubular enclosure portion 17.

More specifically, as best seen in FIGS. 2 and 4, bracket 31 comprises a generally U-shaped bracket having a bight portion 32 and opposite leg portions 33 terminating in opposed distal ends 34. Bight portion 32 rests on shoulders 27, as shown in FIG. 4, and distal ends 34 rest on shoulders 28 as shown therein. The bracket is vertically rigid so as to provide a positive support of the unit 25 on the shoulders 27 and 28. However, the bracket is horizontally flexible and is preferably formed of a resilient material such as metal to bias the distal ends 34 resiliently apart a distance greater than the spacing therebetween when the distal ends are carried on the shoulders 28 in the supporting arrangement of the bracket, as shown in FIG. 4. Thus, the springiness of the bracket effectively retains the bracket in the enclosure 17 on the shoulders 27 and 28 notwithstanding vibration of the vacuum cleaner in normal use.

Motor 24, as shown in FIG. 4, may have a rectangular, herein square, cross section defining substantially planar opposite sides 35 which are engaged by corresponding straight portions 36 of legs 35 so as to snugly embrace the motor subjacent blower portion 23 of unit 25.

Enclosure 17 can further optionally include additional shoulder elements 37 for retaining a shorter motor-blower unit as may be the case with a less powerful unit.

Motor-blower unit 25 is biased downwardly to urge bracket 31 resiliently against shoulders 27 and 28 by a seal element 38 compressed between a flange defining an inturned channel portion 39 at the upper end of housing portion 18, and the upper peripheral edge of the blower 23.

In the illustrated embodiment, the blower 23 is cylindrical in cross section and defines a downwardly facing surface 40 removably resting on the bracket 31. Thus, blower 23 is fitted into the cylindrical portion 18 of housing 17 against flange 39 for preventing substantial lateral movement of the blower-motor unit 25 in the installed arrangement. Bracket 31 further resiliently centers the blower-motor unit 25, as shown in FIG. 4, thereby assisting in maintaining the blower portion 23 centrally of the enclosure portion 18.

Enclosure portion 17 is preferably formed of an insulative material whereby the motor-blower unit 25 is substantially insulatively enclosed within the vacuum cleaner housing. As the mounting structure of the present invention effectively eliminates the need for separate mechanical fastening elements, the mounting of the motor-blower unit 25 is extremely simple and economical while yet providing the highly improved positive support of the unit in the vacuum cleaner.

The unit may be readily installed by simply inverting the vacuum cleaner base 14 and placing the motor-blower unit 25 with the blower portion 23 downwardly into the housing portion 18 against flange 39 after first installing the seal 38 therein. The mounting bracket 31 is then installed and upon returning the vacuum cleaner housing portion 14 to the normal upright position, the motor-blower unit 25 is securely retained in the enclosure portion 17 as shown in FIG. 3.

Operation of the unit 25 causes suction of air through the dirt collecting bag 13 through the upper inlet 20 downwardly through the blower 23 and in heat exchange relationship with motor 24. The air is then discharged through an outlet opening 41 at the rear of the enclosure portion 19, as shown in FIG. 3.

If at any time removal of the unit 25 is desired, such as for servicing or replacement, the unit is readily removed by removal of bottom plate 42 of the vacuum cleaner base 14 and subsequent simple removal of the bracket 31 from the shoulders 27 and 28 permitting the unit to be withdrawn through the lower end of the enclosure portion 19.

Motor 24 is powered by an electric wiring harness, not shown, including conventional push-on terminals which are received on motor connectors 43. A switch, not shown, is conventionally provided for selective actuation by pedal 44 for controlling operation of the unit 25 and hence of the vacuum cleaner 10.

The foregoing disclosure of specific embodiments is illustrative of the broad inventive concepts comprehended by the invention.

Having described the invention, the embodiments of the invention in which an exclusive property or privilege is claimed are defined as follows:

1. Structure for mounting a suction means including an air moving means and an electric drive motor in a vacuum cleaner, comprising: housing means including an integral portion defining an air flow passage having an inlet an an outlet; means defining a plurality of retaining shoulders integral with said air flow passage means; and mounting means for mounting said suction means in said housing means including removable bracket means resting on said retaining shoulders and carrying said suction means in said air flow passage adjacent said inlet for drawing air through said inlet and discharging it through said outlet, said mounting means further defining resilient means engaging said suction means adjacent said inlet for urging the suction means against the bracket means and the bracket means against said shoulders.

2. The vacuum cleaner suction means mounting means of claim 1 wherein said air flow passage means is formed of electrically insulative material.

3. The vacuum cleaner suction means mounting means of claim 1 wherein said suction means defines a downwardly facing peripheral surface resting on said bracket means for support of said suction means thereon.

4. The vacuum cleaner suction means mounting means of claim 1 wherein said drive motor is smaller in horizontal cross section than said air moving means, said air moving means defining a downwardly facing peripheral surface resting on said bracket means for support of said suction means thereon.

5. The vacuum cleaner suction means mounting means of claim 1 wherein said retaining shoulders are disposed at horizontally opposite portions of the air flow passage means.

6. Structure for mounting a suction means including an air moving means and an electric drive motor in a vacuum cleaner, comprising: housing means including an integral portion defining an air flow passage having an inlet and an outlet; means defining a plurality of retaining shoulders integral with said air flow passage means; and mounting means for mounting said suction means in said housing means including removable bracket means resting on said retaining shoulders and carrying said suction means in said air flow passage adjacent said inlet for drawing air through said inlet and discharging it through said outlet, said mounting means further defining resilient means for retaining the bracket means on said shoulders, said retaining shoulders being disposed at horizontally opposite portions of the air flow passage means and said bracket means comprising a U-shaped bracket having a bight portion resting on one of said opposite portions and distal leg portions resting on the other of said opposite portions. 7.

7. The vacuum cleaner suction means mounting means of claim 1 wherein said retaining shoulders are disposed at horizontally opposite portions of the air flow passage means and said bracket means comprises a U-shaped bracket having a bight portion resting on one of said opposite portions and distal leg portions resting on the other of said opposite portions, said bracket means being formed of resilient material, with said distal leg portions being biased apart by the resiliency of the bracket means and thereby being urged into retained association with said other of said shoulder means opposite portions.

8. Structure for mounting a suction means including an air moving means and an electric drive motor in a vacuum cleaner, comprising: housing means including an integral portion defining an air flow passage having an inlet and an outlet; means defining a plurality of retaining shoulders integral with said air flow passage means; and mounting means for mounting said suction means in said housing means including removable bracket means resting on said retaining shoulders and carrying said suction means in said air flow passage adjacent said inlet for drawing air through said inlet and discharging it through said outlet, said mounting means further defining resilient means for retaining the bracket means on said shoulders, said drive motor including a rectangular horizontal cross section portion and said bracket means including straight portions embracing opposite sides of said drive motor portion.

9. Structure for mounting a suction means including an air moving means and an electric drive motor in a vacuum cleaner, comprising: housing means including an integral portion defining an air flow passage having an inlet and an outlet; means defining a plurality of retaining shoulders integral with said air flow passage means; and mounting means for mounting said suction means in said housing means including removable bracket means resting on said retaining shoulders and carrying said suction means in said air flow passage adjacent said inlet for drawing air through said inlet and discharging it through said outlet, said mounting means further defining resilient means for retaining the bracket means on said shoulders, said bracket means being formed of spring metal and defining spaced portions resiliently engaging said housing to closely retain said bracket means in said housing means on said shoulder means.

10. Structure for mounting a suction means including an air moving means and an electric drive motor in a vacuum cleaner comprising: housing means including an integral portion defining an air flow passage having an inlet and outlet and flange means adjacent said inlet; means defining a plurality of retaining shoulders integral with said air flow passage means; bracket means resting on said mounting shoulders and retaining said suction means in said air flow passage for drawing air through said inlet and discharging it through said outlet; and resilient means interposed between said flange and said suction means biasing said suction means downwardly against said bracket means for retaining said bracket means against said mounting shoulders.

11. The vacuum cleaner suction means mounting means of claim 10 wherein said resilient means further seals said air moving means to said air flow passage means.

12. The vacuum cleaner suction means mounting means of claim 10 wherein said resilient means comprises an annular element overlying the air moving means.

13. The vacuum cleaner suction means mounting means of claim 10 wherein said resilient means is disposed adjacent said inlet of the air flow passage means.

14. The vacuum cleaner suction means mounting means of claim 10 wherein said bracket means is vertically rigid.

15. The vacuum cleaner suction means mounting means of claim 10 wherein said bracket means is vertically rigid and horizontally resilient.

16. Structure for mounting a suction means including an air moving means and an electric drive motor in a vacuum cleaner, comprising: housing means including an integral portion defining an air flow passage having an inlet and an outlet; means defining a plurality of retaining shoulders integral with said air flow passage means; and mounting means for mounting said suction means in said housing means including removable bracket means resting on said retaining shoulders and carrying said suction means in said air flow passage adjacent said inlet for drawing air through said inlet and discharging it through said outlet, said mounting means further defining resilient means for retaining the bracket means on said shoulders, said bracket means resiliently engaging said housing means for retaining the bracket means on said shoulders and said resilient means comprising biasing means interposed between flange means adjacent said inlet and said suction means biasing said suction means downwardly against said bracket means for further retaining said bracket means against said mounting shoulders.

17. The vacuum cleaner suction means mounting means of claim 16 wherein said bracket means supports the suction means subjacent said biasing means in aligned association therewith.

* * * * *